United States Patent [19]

Kitaura et al.

[11] Patent Number: 4,470,364

[45] Date of Patent: Sep. 11, 1984

[54] SIDE THRUSTER OF A BOAT

[75] Inventors: Hisayoshi Kitaura; Hiroshi Mizukawa, both of Kobe; Michinobu Hino, Akashi; Junzou Takasu, Kobe, all of Japan

[73] Assignee: Kawasaki Jukogyo Kabushiki Kaisha, Kobe, Japan

[21] Appl. No.: 436,773

[22] Filed: Oct. 26, 1982

[30] Foreign Application Priority Data

Nov. 4, 1981 [JP] Japan ..... 56-165282[U]

[51] Int. Cl.[3] ..... B63H 25/46

[52] U.S. Cl. ..... 114/151; 440/66; 440/78; 415/DIG. 1

[58] Field of Search ..... 114/67 R, 147, 151, 114/243, 148; 440/47, 49, 66, 67, 76–79, 82, 113; 415/DIG. 1; 244/199, 200

[56] References Cited

U.S. PATENT DOCUMENTS

| | | | |
|---|---|---|---|
| 2,021,309 | 11/1935 | Irgens | 440/78 |
| 3,127,865 | 4/1964 | Pleuger | 114/151 |
| 3,454,051 | 7/1969 | Goepfer et al. | 114/243 |
| 3,696,325 | 10/1972 | Tallman | 114/243 |
| 3,884,113 | 5/1975 | Fabula | 114/243 |

FOREIGN PATENT DOCUMENTS

| | | | |
|---|---|---|---|
| 2131101 | 1/1973 | Fed. Rep. of Germany | 114/151 |
| 7585 | 1/1979 | Japan | 114/243 |

*Primary Examiner*—Trygve M. Blix
*Assistant Examiner*—Stephen P. Avila
*Attorney, Agent, or Firm*—Marshall, O'Toole, Gerstein, Murray & Bicknell

[57] ABSTRACT

This disclosure relates to a side thruster for a ship. The thruster includes a propeller mounted in a cylindrical tunnel formed on the ship, and a housing-support is connected between the propeller and the hull of the ship for supporting the propeller in the tunnel. The housing-support extends substantially transversely of the direction of water flow through the tunnel, and it is generally elliptical in cross section. At least one enlargement is formed on the outer surface of the housing-support for reducing the effect of Kármán vortexes, and the enlargement preferably spirals around the outer surface of the housing-support.

1 Claim, 3 Drawing Figures

SIDE THRUSTER OF A BOAT

The present invention relates to a side thruster for a boat or ship, which produces less vibration and noise than conventional thrusters.

With reference to FIG. 1, a conventional side thruster of a ship comprises a screw propeller 2 that is rotatably mounted in a tunnel or laterally oriented cylindrical hole 1 which is formed in the hull 1A of the ship below the water line. The propeller 2 includes a gearbox 3 containing bevel gears 9 and supporting propeller blades, and a vertical power shaft 5 driven by a motor 4 which is mounted in the ship's hull. The propeller blades are driven by the rotating gears 9, shaft 5 and motor 4, so that the propeller 2 thrusts the water through the tunnel 1. In FIG. 1, the direction of water flow is toward the left.

The side thruster further comprises a pod-shaped housing-support 6 which encloses the shaft 5 and extends transversely of the tunnel 1, and which is secured to the tunnel wall 1A and the propeller to support the propeller 2.

Because many of the parts in the housing-support 6 are circular in cross section, such as the shaft 5 and its supporting bearings (not shown), the housing-support is usually formed with an elliptical outer contour which is illustrated in FIG. 1 by the hatched section 7 that is turned 90° from the axis of the housing-support 6, in order to reduce fluid resistance, etc.

The elliptical contour of the housing-support produces "Kármán vortexes" which are periodically occurring vortexes 8 (FIG. 1) formed on both sides of the housing-support 6. The vortexes 8 are illustrated in relation to the manner in which they are formed when water flows past the turned contour 7. The vortexes 8 directly or indirectly cause vibration and noise during operation.

If the outer contour 7 is symmetrical about its axis which is parallel to the water flow, as is the case in FIG. 1, vortexes of the same magnitude are produced at regular intervals alternately from both sides of housing-support 6, which cause more serious vibrations. In order to minimize the production of such vortexes, it is customary to shape the forward (or right-hand) end of the housing-support asymmetrically in cross section, thereby destroying the periodicity of the vortexes, and/or to decrease the angle in cross section of the forward end.

However, the formation of the contour of the housing-support 6, as discussed above to prevent the problem, necessitates a lengthening of the contour in the direction of water flow, thereby lengthening the thruster as a whole in the direction of the axis of the tunnel 1. This increases the manufacturing costs, and such a long thruster cannot be equipped in a narrow ship.

It is the principle object of this invention to provide an improved side thruster for a ship, which comprises uncomplicated means for reducing the energy level of the Kármán vortexes produced around the housing-support of a side thruster, thereby reducing the vibration and noise level.

Apparatus in accordance with the present invention is for use as part of a side thruster of a ship, the thruster including a propeller mounted in a tunnel formed in the hull of a ship. The apparatus comprises a housing-support adapted to be attached to the propeller and to the hull for supporting the propeller, the housing-support extending generally transversely of the axis of the tunnel and the direction of water flow, said housing-support having an outer peripheral wall, and at least one enlargement formed on and extending around the outer surface of said peripheral wall.

Apparatus in accordance with the present invention further comprises a propeller including said housing-support having an enlargement thereon.

The foregoing and other objects may be better understood from the following detailed description taken in conjunction with the accompanying figures of the drawings, wherein:

With reference to FIG. 2, the parts and components corresponding to those shown in FIG. 1 are given the same reference numerals as in FIG. 1.

Figure 1:
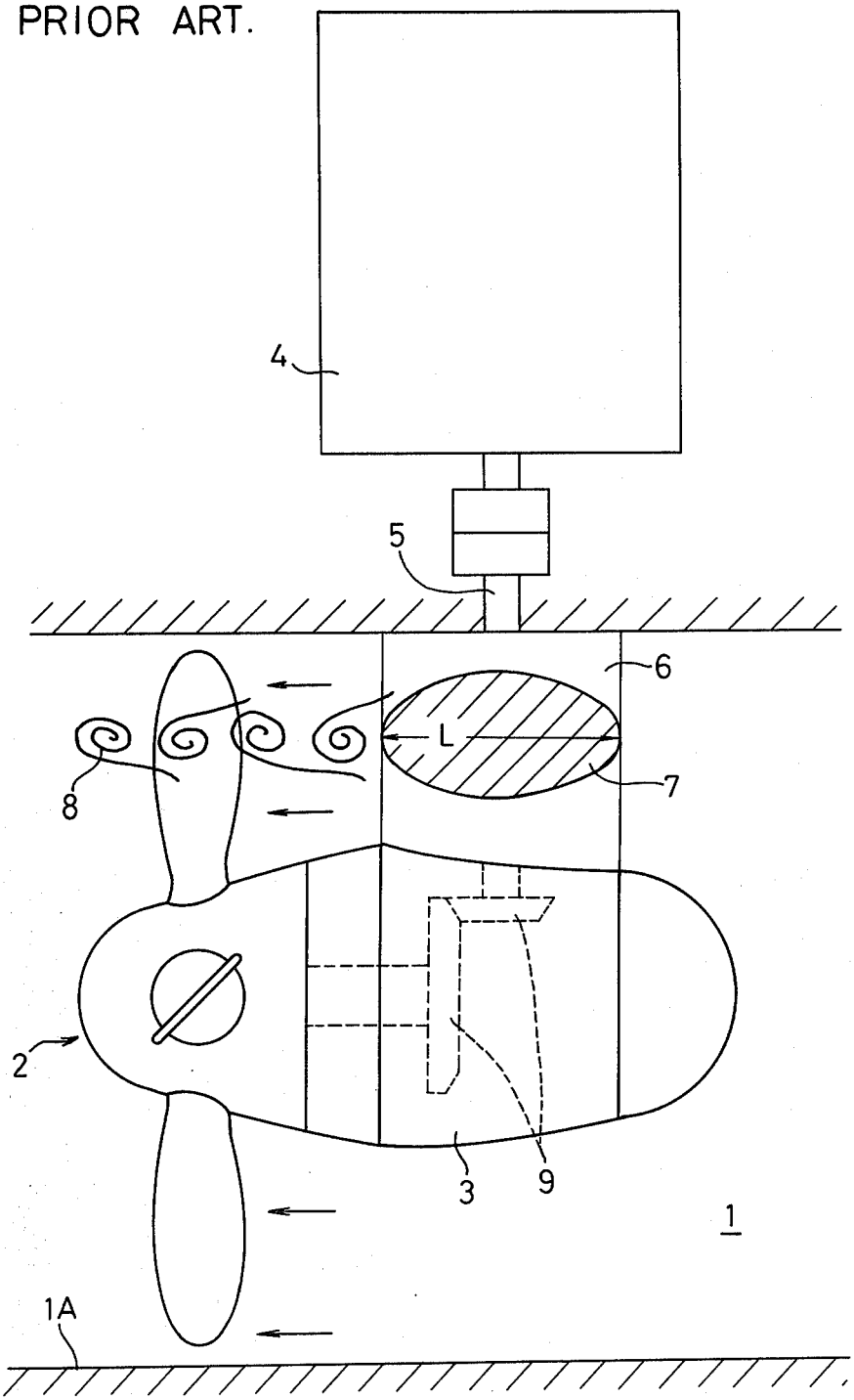
FIG. 1 PRIOR ART.
FIG. 1 is a schematic diagram partially in section of a prior art side thruster.
Figure 2:
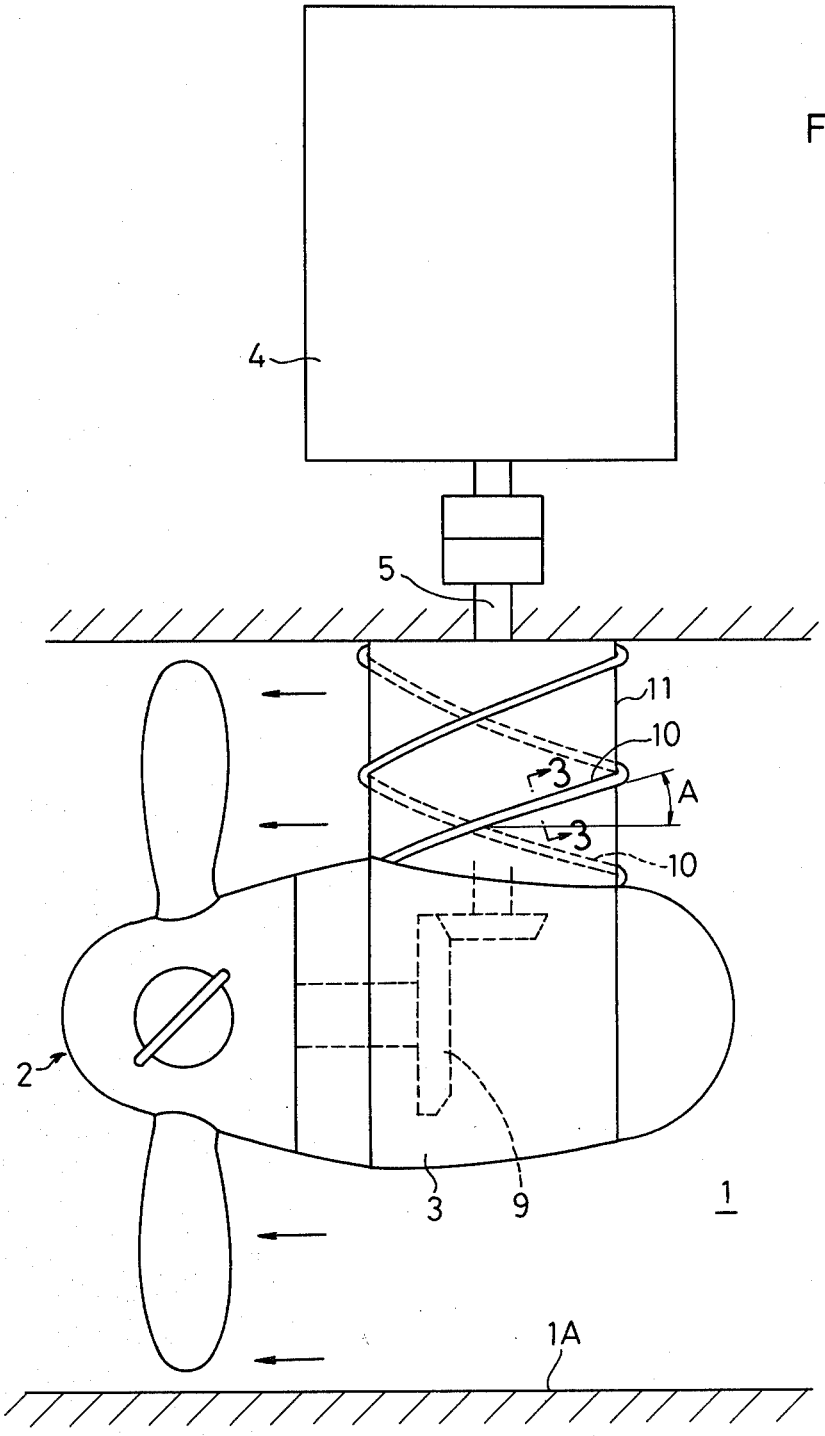
FIG. 2 is a schematic diagram similar to FIG. 1 but showing a side thruster in accordance with this invention.

The side thruster shown in FIG. 2 includes a tunnel 1, propeller 2, gearbox 3, motor 4 and drive shaft 5 which may be the same as the corresponding parts shown in FIG. 1.

Figure 3:
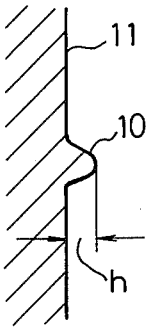
FIG. 3 is an enlarged fragmentary sectional view on the line 3—3 in FIG. 2.

The side thruster further includes a housing-support 11 in accordance with this invention, which preferably has an elliptical contour or outer surface. At least one enlargement 10 (FIGS. 2 and 3) is formed on the outer peripheral surface of the housing-support 11. In the preferred specific example shown in FIG. 2, two spaced spiral enlargements 10 extend around the housing-support and are displaced by 180°. The enlargement 10 may be formed integrally with the housing-support 11 by casting (as shown in FIG. 3), or a bar or rod may be coiled around and welded to the housing-support. The enlargements preferably extend the entire length of the housing support from the hull 1A to the propeller 2.

The asymmetry of the spiral enlargement 10 relative to the axis of the contour which is parallel to the water flow, prevents the formation of periodic, Kármán vortexes of the same magnitude on both sides of the housing-support, without the necessity of an asymmetrical form of the contour. In addition, the spiral arrangement of the enlargement 10 changes the vertical positions around the housing support 11 where vortexes occur, and it deflects the movements of the vortexes, thereby considerably lowering the energy level of each vortex so that it cannot cause substantial vibration.

It has been experimentally determined that optimum results are obtained when the angle 'A' (FIG. 2) which the spiral enlargement 10 makes relative to the tunnel axis is preferably in the range between 20°–40°, and that the ratio of the height 'h' (FIG. 3) of spiral enlargement 10 to the longest diameter 'L' (FIG. 1) of housing-support 11, which diameter is parallel to the axis of the tunnel and the propeller 2, is effectively 2–3%.

Thus, this invention can be applied to a conventional side thruster without substantially affecting the construction and performance of the thruster. Enlargements may be formed on existing side thrusters, and they may, of course, be included in new constructions.

We claim:

1. A side thruster for a ship having a tunnel formed in its hull below the water line, said thruster comprising a propeller adapted to be positioned in said tunnel, a housing-support attached to said propeller and adapted to be attached to said hull and to extend into said tunnel for supporting said propeller in said tunnel, said propeller being adapted to thrust the water through said tunnel, said housing-support extending transversely of said tunnel and the direction of water flow through the tunnel and having an outer peripheral wall, said housing-support having a substantially elliptical cross section, and said ellipse having axes which extend substantially transversly of said tunnel and said direction of water flow, and at least one spiral enlargement formed on and extending around said outer peripheral wall, said spiral enlargement forming an angle of substantially 20°–40° relative to said axes and said direction of the flow of said water, and the ratio of the height of said enlargement relative to the diameter of said housing-support in the direction of water flow being substantially 2–3%.

* * * * *